US006527064B1

(12) United States Patent
Hallundbaek

(10) Patent No.: US 6,527,064 B1
(45) Date of Patent: Mar. 4, 2003

(54) ASSEMBLY FOR DRILL PIPES

(75) Inventor: Jorgen Hallundbaek, Allerod (DK)

(73) Assignee: Welltec Aps, Allerod (DK)

( * ) Notice: Subject to any disclaimer, the term of this patent is extended or adjusted under 35 U.S.C. 154(b) by 0 days.

(21) Appl. No.: 09/673,320

(22) PCT Filed: Apr. 14, 1998

(86) PCT No.: PCT/DK98/00153

§ 371 (c)(1),
(2), (4) Date: Nov. 30, 2000

(87) PCT Pub. No.: WO99/53169

PCT Pub. Date: Oct. 21, 1999

(51) Int. Cl.[7] ..... E21B 17/18
(52) U.S. Cl. ..... 175/320; 166/242.1; 166/242.6
(58) Field of Search ..... 175/320; 166/242.1, 166/242.6

(56) References Cited

U.S. PATENT DOCUMENTS 1,944,219 A * 1/1934 Chilton ..... 285/405
2,294,806 A * 9/1942 Samans ..... 285/328
2,336,333 A * 12/1943 Zublin ..... 175/290
3,947,009 A * 3/1976 Nelmark ..... 175/320
4,836,305 A * 6/1989 Curlett ..... 175/215
5,129,459 A * 7/1992 Breese et al. ..... 137/625.46
5,299,644 A * 4/1994 Eckert ..... 166/379
5,332,049 A * 7/1994 Tew ..... 138/109
6,325,162 B1 * 12/2001 Eppink et al. ..... 175/320

* cited by examiner

*Primary Examiner*—Hoang Dang
(74) *Attorney, Agent, or Firm*—Nath & Associates PLLC; Gary M. Nath; Harold L. Novick

(57) ABSTRACT

In an assembly for cylindrical drill pipes made for the transport of different kinds of fluids, a combined flange assembly can combine the functions and can be assembled under low time consumption and at low cost. Drill rods are connected by axially directed bolts inserted in the outer wall of a first drill rod (1) and extending axially past the end of the first drill rod (1) into internally threaded blind holes (21, 22) in the next drill rod to be connected to the first drill rod. Each terminal surface of a drill rod is made with arrangements (13–17, 23–27) for at least one coupling plug (31, 33) for the transport of different kinds of fluids in the drill string.

8 Claims, 6 Drawing Sheets

ASSEMBLY FOR DRILL PIPES

FIELD OF THE INVENTION

The present invention refers to an assembly for a cylindrical drill pipe for different kinds of fluids, where the drill pipes are coupled together so as to form a long drill string.

BACKGROUND OF THE INVENTION

It is widely known, that drill pipes can be assembled with a coarse thread. With such pipes it is possible to transport one fluid in the pipe, and such transport has until now been sufficient for the users on drilling rigs.

Recently, the need for transporting more than one fluid has developed, but assembling drill pipes with more than one channel for different kind of fluids has met some difficulties, as the threads often are worn differently and can never be tightened to a degree, where no leaks are present and at the same time secure, that the fluids are transported without being mixed through the proper channels in the pipes.

A pipe for more than one fluid is known from NO-B 169,797, where a main pipe is assembled using an internal lining in the joining of the main pipe, and an auxilary pipe is assembled next to the main pipe using locking and sealing rings. The assembly is held with external flanges connected to each other by bolts.

The surface of such connection is obviously not cylindrical or rotational symmetric around the centre axis and it is evidently not able to be used in a drill string, where the drill string is to be rotated during drilling operations.

In order to achieve a more smooth surface it is suggested in US-B 2,294,806 to connect external flanges with axially directed, "internal bolts" being coun-tersunk with an opening sufficient for the service crew to turn the axially directed screws and thereby connect the pipes.

The subject matter of that publication is, however, not suited for being used in a drill string, as the assembly is not cylindrical and the flanges increases the diameter and thereby make the use of the drill string not feasable. Further, this technique is not suitable for transporting more than one fluid.

SUMMARY OF THE INVENTION

On this background it is the object of the invention to provide means for axially connecting drill pipes being able to transport separate fluids in a drill string.

To this end the inventions suggests that the connecting means are axially directed bolts inserted in the outer wall of the drill rod and extending axially past the end of the drill rod into internally threaded blind holes in the next drill rod to be connected to the first drill rod, and that each terminal surface of a drill rod is made with arrangements for at least one coupling means for the transport of different kind of fluids in the drill string.

With a drill pipe according to the invention it is possible both to connect drill pipes into one drill string without outer flanges and to transport different fluds in the drill string. Such fluids can be drilling mud for the drilling, brine, and e.g. hydraulic fluids. When assembling the drill rods to a drill string it is important that the connection according to the invention can be made without outer flanges or external auxilary pipes, as such protrusions would prevent the use of the drill string as a rotational device.

The prior art known from US-A-5299644 has only the axial directed bolts in common with the subject matter invention, as the bolts are arranged outside the circumference of the drill rods, i.e. not cylindrical shape. In addition, the tubular head exhibits different outer diameters and is far from cylindrical. Each of those two features will separately block the use of this prior art in a string of tubes, as the string can not rotate in the well because of the external bolts, and the tubular head with its larger diameters will stick in the well. Combining this prior art with the other cited prior art will still not solve the problem of providing means for axially connecting drill pipes being able to transport separate fluids in a drill string.

One preferred embodiment of the assembly for drill pipes can be found in, that the bolts are accessed through pocket openings in the outer wall of the drill rod in the proximity of the end of the drill rod, where the bolts are reaching into the internally threaded blind holes in the next drill rod, and that the pocket openings are of a width sufficient for screwing or unscrewing the bolts.

With such embodiment the assembly can be assembled manually under visual inspection of the assembly.

If the end surfaces of the drill rods are equipped with at least one guide pin and/or a corresponding recess, respectively, it will be easy to establish the correct connection and reduce the shearing forces on the bolts, and if the guide pins are shaped e.g. as truncated cones or tetrahedra with a cylindrical base portion, and the recesses each have a shape matching the guide pins, the connection can be performed with a greater precision in a faster way.

In another preferred embodiment of the flange assembly the coupling means for the fluids are made as coupling plugs provided with suitable sealing means. Thereby it will be possible in each assembling to choose, whether or not a fluid connection shall be established through the relevant fluid coupling.

In still another preferred embodiment of the flange assembly the bolts are actuated by one or more fluid motors in the drill rod. Thereby it can be advantageous that the fluid motors be driven from the other end of the drill rod, where suitable fluid couplings connect the fluid motors to a pressure source with regulating and surveillance means. With such embodiment it would not be necessary to mill the pocket openings in the distal wall of a drill rod.

BRIEF DESCRIPTION OF THE DRAWINGS

Further advantageous embodiments will appear in the claims. The invention will be disclosed further in the following special specification with reference to the drawings, in which it is shown on:

DETAILED DESCRIPTION

Figure 1:
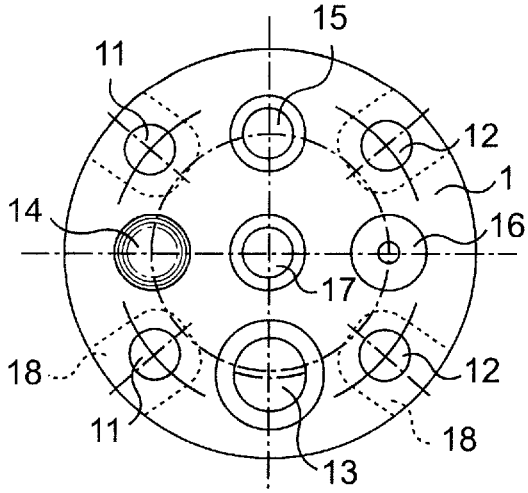
FIG. 1 a view of the distal end of a flange assembly according to the invention.
Figure 1A:
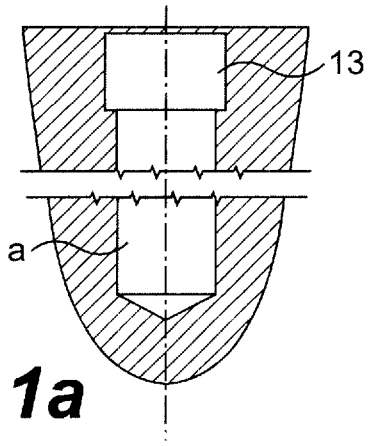
FIGS. 1*a–e* examples of longitudinal sections of the holes for the coupling plugs.
Figure 1B:
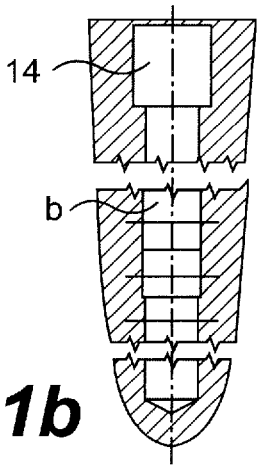
Figure 1C:
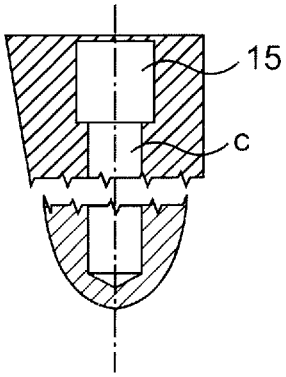
Figure 1D:
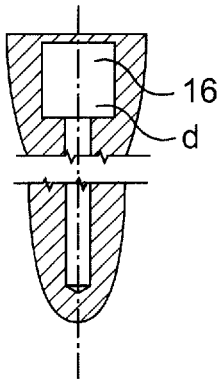
Figure 1E:
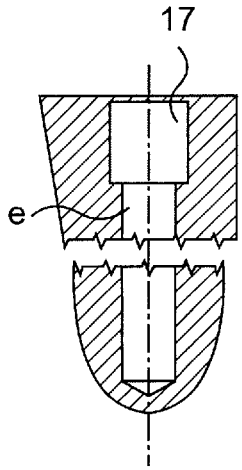

A view of the distal end 1 of a flange assembly is shown in FIG. 1, where the assembly means in this embodiment consist of four holes 11, 12 for the bolts not shown, and the fluid couplings are an arrangement of radially stepped holes 13, 14, 15, 16, 17 matching corresponding coupling plugs sealed with O-rings. The holes 13–17 are also shown in longitudinal sections a, b, c, d, e in order to show examples of the different hole types used for the different fluids flowing through the fluid couplings, where different fluids have different needs depending of the flow velocity, flow capacity and viscocity of the fluid. The pocket openings 18 are shown with dotted lines around the holes 11, 12. From this it can be seen, that the pocket openings 18 are sufficiently wide for the working with a tool to screw or unscrew the bolts.

Figure 2:
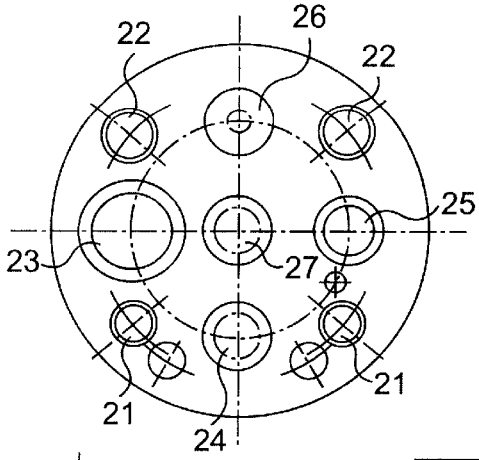
FIGS. 2 a view of the proximal end of a flange assembly.
Figure 2A:
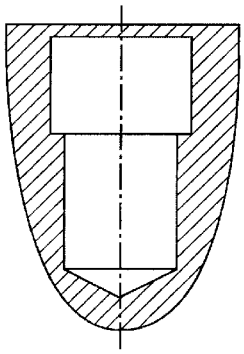
FIG. 2*a–g* examples of longitudinal sections of the holes for the coupling plugs.
Figure 2B:
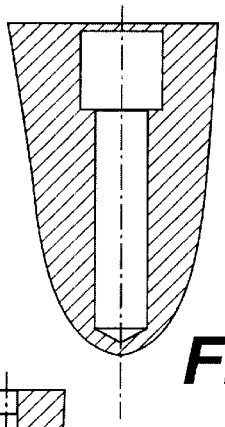
Figure 2C:
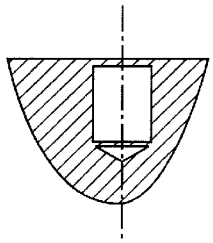
Figure 2D:
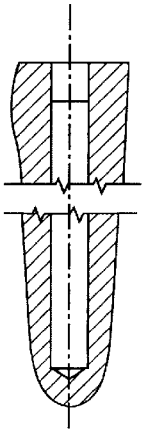
Figure 2E:
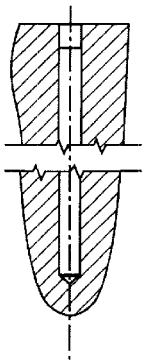
Figure 2F:
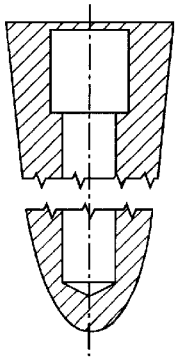
Figure 2G:
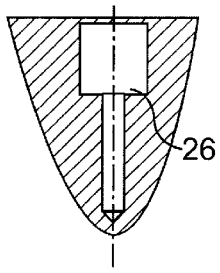
Figure 2H:
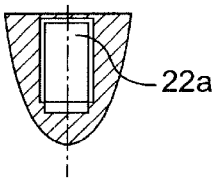
FIGS. 2*h–i* examples of longitudinal sections of the blind holes for the bolts.
Figure 2I:
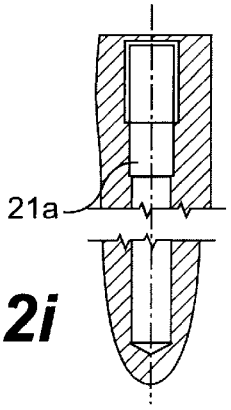

In FIG. 2 the proximal end of a flange assembly is shown where particularly the blind holes 21, 22 for the bolts are shown both with a topological localization and with a sectional representation 21*a*, 22*a*, thereby indicating the shape of the blind hole. Two of the blind holes are short 22*a* and two are long 21*a*. This has no direct significance in relation to the invention, but might be practical for the production.

The fluid couplings are like in FIG. 1 an arrangement of radially stepped holes 23, 24, 25, 26, 27 matching corresponding coupling plugs sealed with O-rings. The holes 23–27 are also shown in different longitudinal sections in order to show examples of the different hole types used for the different fluids flowing through the fluid couplings like in FIG. 1.

Figure 3:
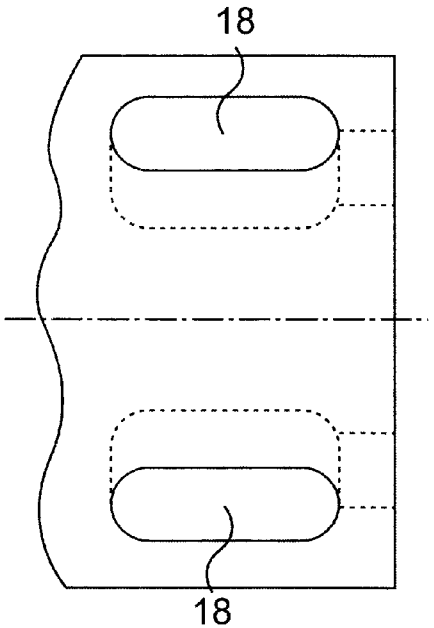
FIG. 3 the distal end of a flange assembly in a side elevation showing the pocket holes.

In FIG. 3 the distal end of an assembly is shown with the pocket openings 18 for the bolts. The pocket openings are made by milling the opening. After use, the screws can be removed simply by rinsing the pocket openings before using the tool. It shall be noted, that the length of the pocket openings 18 must at the least be sufficient for placing the bolts in the holes and using the tool all the way up to release of the bolt from the threads in the corresponding blind holes in the proximal part of the next drill rod.

Figure 4:
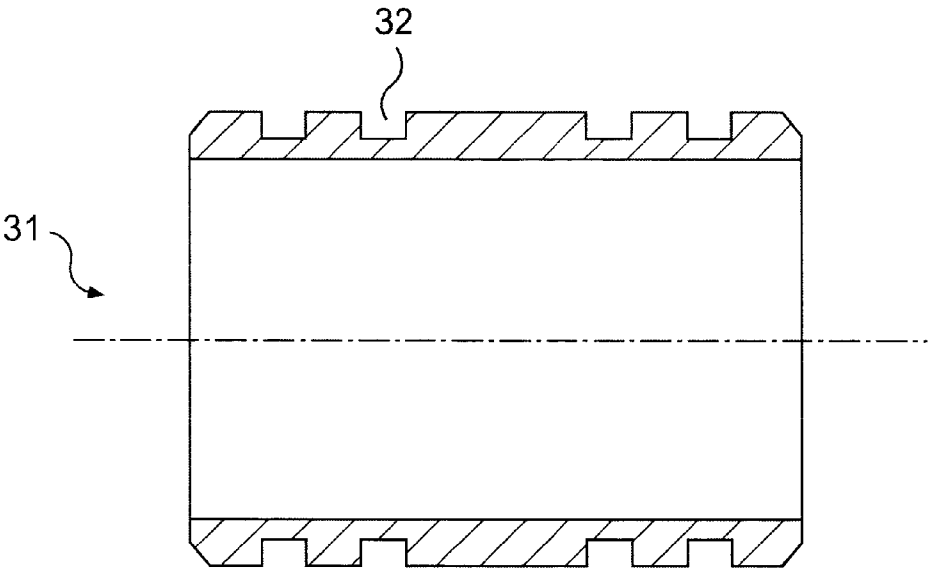
FIG. 4 an embodiment of a coupling plug for a fluid.
Figure 5:
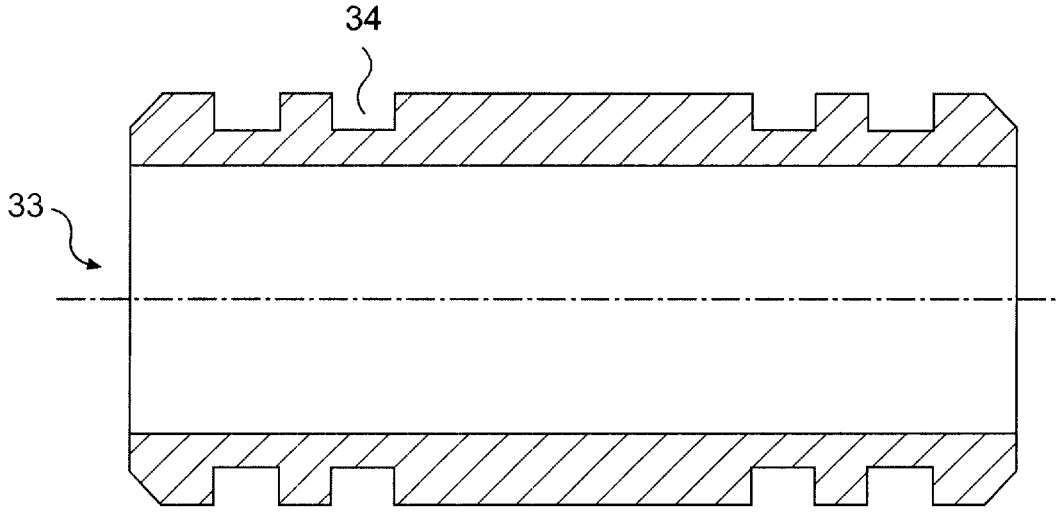
FIG. 5 another embodiment of a coupling plug for a fluid.

FIG. 4 and 5 show each one embodiment of a coupling plug 31, 33 for the fluids flowing through the drill string. The plug is equipped with a total of four grooves 32, 34 for O-rings for the sealing of the plug 31, 33, thereby securing a tight coupling, that can be released when the bolts are removed.

A drill rod can be a simple unit, just performing the functions of a drill string and guiding the fluids through from one end to the other. Also, a drill rod can perform certain functions with the help of the fluids flowing through the drill rod. In that way the drill rod can e.g. be equipped with traction means mounted on pivotable arms with traction motors, or a drill motor for a drill bit.

Figure 6:
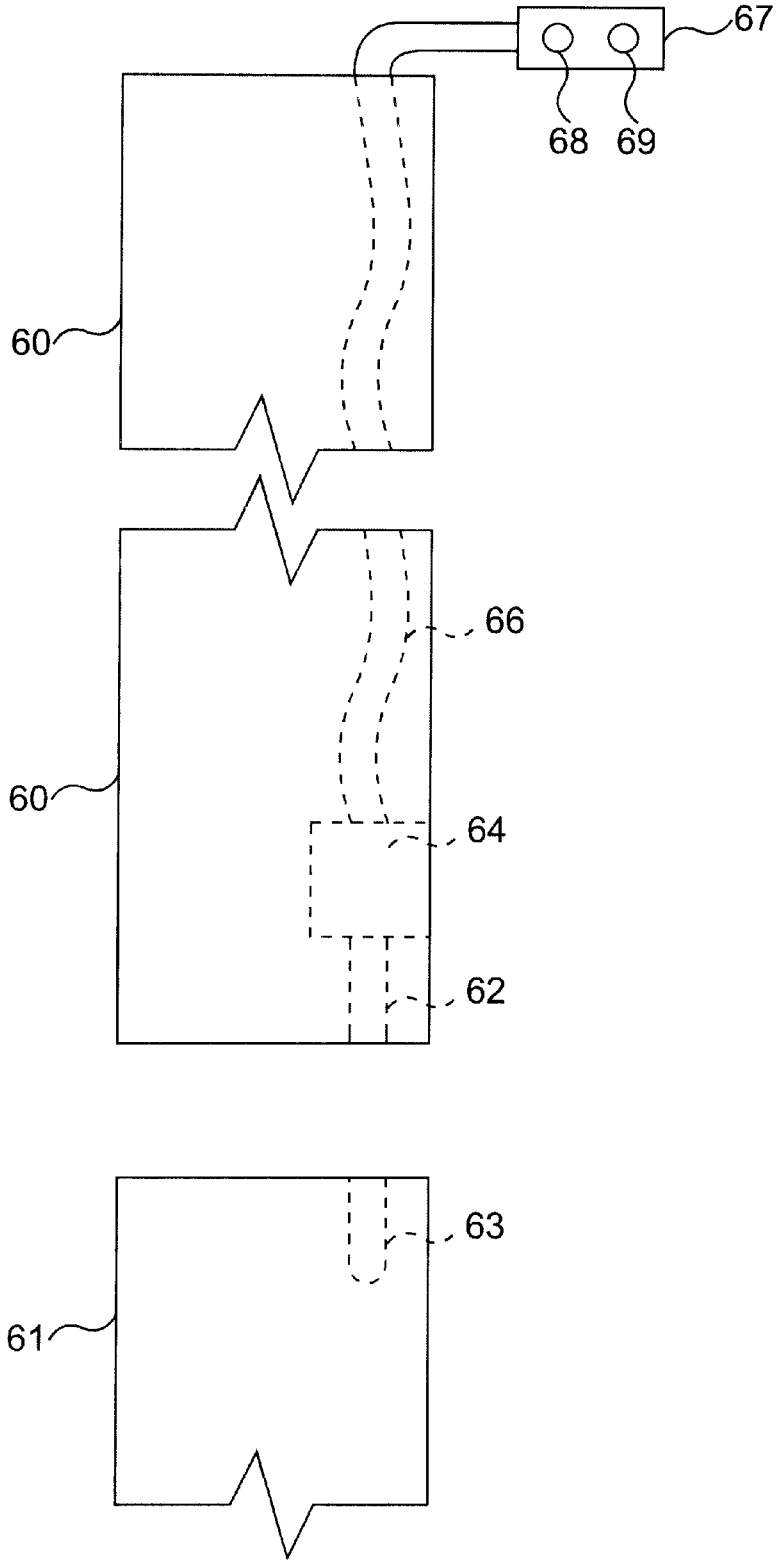
FIG. 6 schematic box diagram of a front elevation view of an embodiment of the invention showing a fluid motor, connecting means and pressure source.
Figure 7:
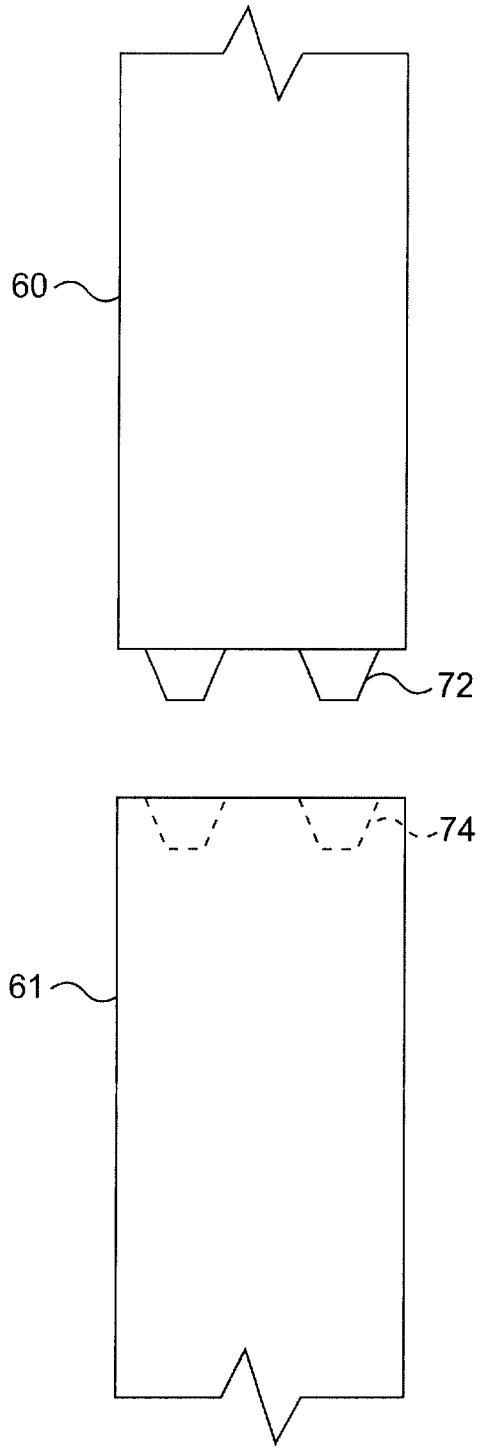
FIG. 7 schematic diagram of a front elevation view of an embodiment of the invention showing protrusions and recesses.

In one of the above mentioned embodiments of the flange assembly, and as shown in FIG. 6, the bolts 62 are actuated by one or more fluid motors 64 in the first drill rod 60 and can be inserted into blind holes 63 in the next drill rod 61. Fluid motors 64 are connected by fluid connecting means 66 to a pressure source 67 equipped with regulating means 68 and surveillance means 69. In another embodiment, shown in FIG. 7, guide pins, or protrusions 72 and corresponding recesses 74 are used.

What is claimed is:

1. An assembly for connecting drill rods in a drill string which transport different kinds of fluids through separate passageways therethrough, said drill string being comprised of at least a first cylindrical drill rod and an adjacent cylindrical drill rod, each drill rod having a terminal surface, the assembly comprised of:

a) a connecting means comprising axially directed bolts internally situated in an outer wall of the drill rod and extending axially past an end of said first drill rod into internally threaded blind holes in the adjacent drill rod to be connected to the first drill rod; and b) each terminal surface made with arrangements for at least one coupling means for the transport of different kinds of fluids in the drill string.

2. Assembly according to claim 1, characterized in that a) the bolts are accessed through long pocket openings in the outer wall of the first drill rod in a proximity of the end of said first drill rod, where the bolts reach into the internally threaded blind holes in the adjacent drill rod; and b) the pocket openings are of a width sufficient for screwing or unscrewing the bolts.

3. Assembly according to claim 2, characterized in that the pocket openings have a length and a width and each bolt has a head and a length, wherein the length of the pocket openings is at least larger than the length of the bolts, and the width of the pocket openings is approximately of a same size as the bolt heads.

4. Assembly pipes according to claim 1, characterized in that the coupling means comprise coupling plugs provided with suitable sealing means.

5. Assembly according to claim 1, characterized in that the bolts are operated by one or more fluid motors in the first drill rod.

6. Assembly according to claim 5, characterized in that the fluid motors are driven from an opposite end of the first drill rod, where suitable fluid couplings connect the fluid motors to a pressure source with regulating and surveillance means.

7. Assembly according to claim 1, characterized in that the drill rods have end surfaces equipped with protrusions and/or recesses, matching each other, respectively.

8. Assembly according to claim 7, characterized in that the protrusions are shaped as a truncated cone and the recesses have a shape matching the protrusions.

* * * * *

UNITED STATES PATENT AND TRADEMARK OFFICE

CERTIFICATE OF CORRECTION

PATENT NO. : 6,527,064 B1
DATED : March 4, 2003
INVENTOR(S) : Hallundbaek

It is certified that error appears in the above-identified patent and that said Letters Patent is hereby corrected as shown below:

Column 4,
Line 39, after "Assembly" and before "according", delete "pipes".

Signed and Sealed this

Nineteenth Day of August, 2003

JAMES E. ROGAN
*Director of the United States Patent and Trademark Office*